US007628389B2

(12) United States Patent
Steinert et al.

(10) Patent No.: US 7,628,389 B2
(45) Date of Patent: Dec. 8, 2009

(54) GATHERER STITCHER FOR BROCHURES

(75) Inventors: Andreas Steinert, Beucha (DE); Siegmar Tischer, Borsdorf (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 788 days.

(21) Appl. No.: 11/122,808

(22) Filed: May 4, 2005

(65) Prior Publication Data

US 2005/0249575 A1 Nov. 10, 2005

(30) Foreign Application Priority Data

May 4, 2004 (DE) ..... 10 2004 021 960

(51) Int. Cl.
*B65H 37/04* (2006.01)

(52) U.S. Cl. ..... 270/52.26; 270/52.14; 270/52.17; 270/52.18; 270/52.29

(58) Field of Classification Search ..... 270/52.14, 270/52.17, 52.18, 52.26, 52.29; 412/16, 412/33, 35

See application file for complete search history.

(56) References Cited

U.S. PATENT DOCUMENTS

| | | | | | |
|---|---|---|---|---|---|
| 4,236,706 | A | * | 12/1980 | Schlough | 270/52.18 |
| 4,260,145 | A | * | 4/1981 | Mebus et al. | 270/52.14 |
| 4,479,642 | A | * | 10/1984 | Macey | 270/58.08 |
| 4,519,599 | A | * | 5/1985 | Mayer | 270/52.18 |
| 5,326,087 | A | * | 7/1994 | Colson et al. | 270/58.02 |
| 5,622,268 | A | * | 4/1997 | Conner et al. | 209/603 |
| 5,732,453 | A | * | 3/1998 | Dilo et al. | 28/114 |
| 5,772,195 | A | * | 6/1998 | Mueller | 270/52.16 |
| 5,810,345 | A | * | 9/1998 | Lehmann et al. | 270/52.26 |
| 5,820,325 | A | * | 10/1998 | Hartsoe | 412/1 |
| 6,161,269 | A | * | 12/2000 | Dilo et al. | 28/114 |
| 6,994,337 | B1 | * | 2/2006 | Cracknell et al. | 270/52.29 |
| 2002/0014510 | A1 | | 2/2002 | Richter et al. | |
| 2002/0061239 | A1 | | 5/2002 | Bohn et al. | |
| 2003/0061700 | A1 | * | 4/2003 | Steinert et al. | 29/592 |
| 2003/0214092 | A1 | * | 11/2003 | Horii et al. | 270/52.18 |
| 2005/0201850 | A1 | * | 9/2005 | Numberger et al. | 412/35 |

FOREIGN PATENT DOCUMENTS

| | | | |
|---|---|---|---|
| DE | 40 13 401 | A1 | 10/1991 |
| EP | 0 992 365 | A1 | 4/2000 |
| EP | 1 331 105 | A2 | 7/2003 |
| EP | 1 354 721 | A2 | 10/2003 |
| WO | 0 962 334 | A1 | 12/1999 |

* cited by examiner

*Primary Examiner*—Gene Crawford
*Assistant Examiner*—Leslie A Nicholson, III
(74) *Attorney, Agent, or Firm*—Laurence A. Greenberg; Werner H. Stemer; Ralph E. Locher

(57) ABSTRACT

A gatherer stitcher for brochures has a stitching machine, a delivery station that receives brochures step-by-step during operation, a trimming apparatus, and transport components (brochure ejector, trimmer feed) that transport the brochures from the delivery station to the trimming apparatus during operation. Sensors assigned to the stitching machine and the transport components output signals defining their phase position, and a control system processes the signals. One of the transport components (brochure ejector; trimmer feed) is activated in such a way that the brochures assume a correct position in the trimming apparatus at a predetermined phase angle of the stitching machine, without regard to their width. Changeover times in the event of job changes required when the brochure width changes are shortened.

3 Claims, 5 Drawing Sheets

GATHERER STITCHER FOR BROCHURES

BACKGROUND OF THE INVENTION

Field of the Invention

The invention relates to a gatherer stitcher for brochures, comprising a stitching machine, a delivery station charged step-by-step with brochures during operation, a front cut knife arrangement defining a cutting plane for trimming the brochures along their respective intended cut line, and comprising transport means components which transport the brochures from the delivery station to the front cut knife assembly during operation.

Gatherer stitchers of that type have been marketed by Brehmer Buchbindereimaschinen GmbH of Leipzig, Germany, under the type designation ST300. Those devices are configured such that the brochures, until stitching and subsequent provision in the delivery station have been carried out, are transported in the longitudinal direction of the spines of the brochures and, in the delivery station, are transferred by way of an ejector to delivery tapes. The latter then convey the brochures onward transversely with respect to their previous transport direction, specifically in the direction of a trimmer. There, first of all a front edge cut and then a top cut and a bottom cut are carried out.

As a result of the change in the transport direction, the width of the brochures becomes a process-relevant geometric parameter, which is taken into account by means of appropriate adjustments of the phase angles of the machine components affected by this parameter. As a result, a considerable effort arises for converting a gatherer stitcher for a job change in which, in particular, the width of the brochures also changes.

SUMMARY OF THE INVENTION

It is accordingly an object of the invention to provide a gatherer stitcher for brochures which overcomes the above-mentioned disadvantages of the heretofore-known devices and methods of this general type and which is modified in such a way that the conversion effort is reduced in the event of a job change in which the width of the brochures changes.

With the foregoing and other objects in view there is provided, in accordance with the invention, a gatherer stitcher for brochures, comprising:

- a stitching machine;
- a delivery station receiving brochures step-by-step during operation;
- a front cut knife assembly defining a cutting plane for trimming the brochures along a respective intended cut line;
- transport components (brochure ejector, a trimmer feed) for transporting the brochures from the delivery station to the front cut knife assembly during operation;
- sensors configured to output signals defining phase positions of the stitching machine and of one of the transport components; and
- a control system connected to receive and process the signals from the sensors, and to activate the one transport component such that, given a predetermined phase position of the stitching machine, the respective intended cut line is located in the cut plane, independently of a width of the respective brochure.

In other words, the objects of the invention are achieved in that sensors are provided which output signals defining the phase position or phase angles of the stitching machine and one of the transport components. A control system that processes these signals and activates the one of the transport components in such a way that, given a predetermined phase angle of the stitching machine, the respective intended cut line is located in the cut plane, independently of the width of the respective brochure.

In the event of a job change in which the width of the brochures changes, this saves any adjustment of the phase angle of the drive for the front cut knife arrangement and, furthermore, provides the advantage that, in the case of a common drive for the stitching machine and the front cut knife arrangement, the result is an always constant loading profile of this drive and that this drive can be designed for the specific loading profile. Therefore, possible functional disruption is prevented and performance restrictions are counteracted.

In accordance with a concomitant feature of the invention, the transport components comprise a brochure ejector and an ejector drive for imparting a periodic ejection movement to the brochure ejector, one of the sensors is disposed to detect a phase angle of the ejector drive, and the control system is configured to activate the ejector drive accordingly.

Other features which are considered as characteristic for the invention are set forth in the appended claims.

Although the invention is illustrated and described herein as embodied in a gatherer stitcher for brochures, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
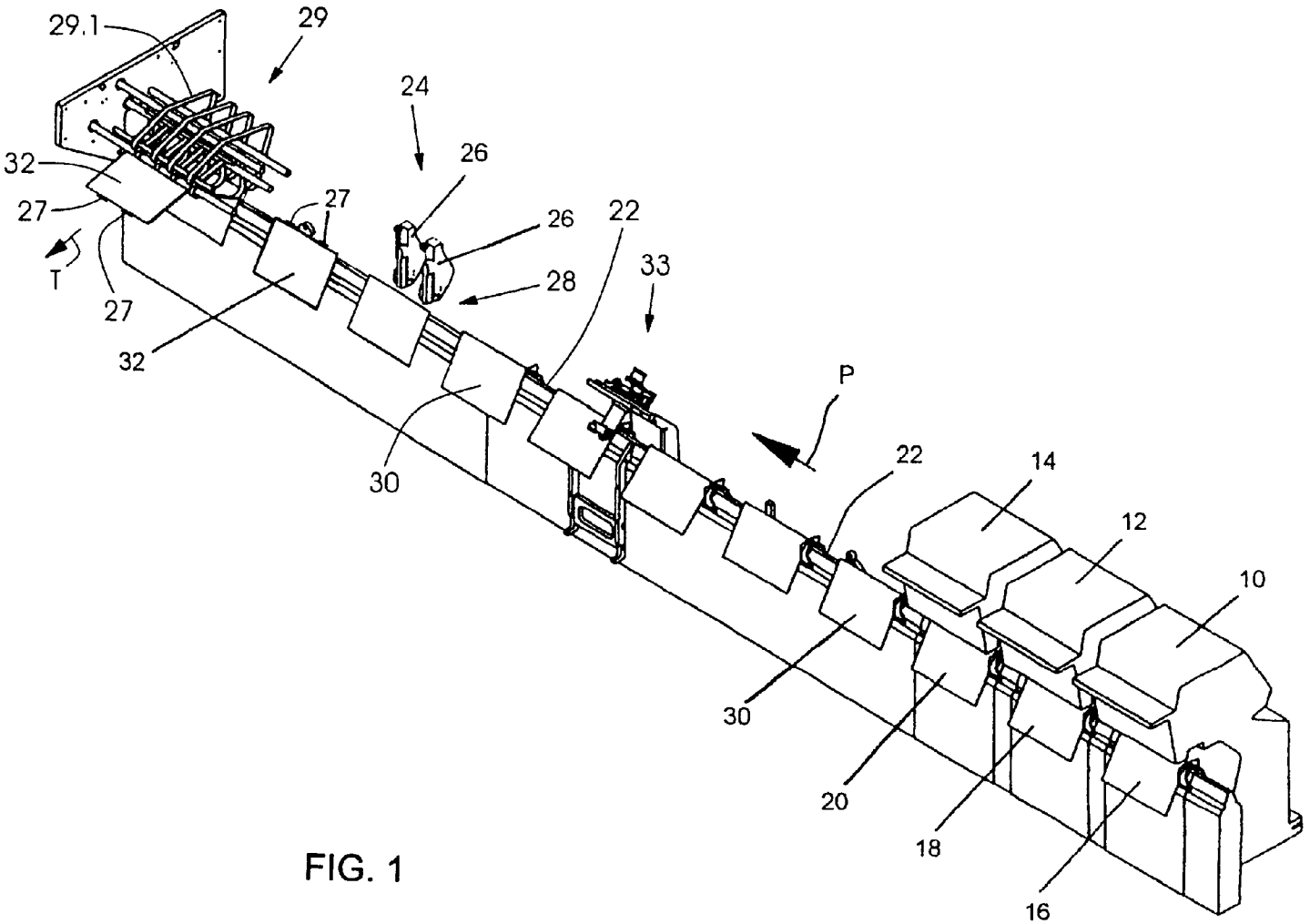
FIG. 1 is a simplified perspective illustration of a gatherer stitcher.

Referring now to the figures of the drawing in detail and first, particularly, to FIG. 1 thereof, there is shown a gatherer stitcher according to an exemplary embodiment of the present invention. The device includes three feeders 10, 12, 14, which in each case transfer a signature 16, 18, 20 to a continuous conveyor 34 (cf. FIG. 2A). The signatures 16, 18, 20 placed on and above one another in this way together form a brochure 30 in which, as the brochure being formed before, is transported in a transport direction (arrow P) along a transport and stitching line 22. The latter extends along the feeders 10, 12, 14 and beyond a stitching station 24 as far as a delivery station 29. The stitching station 24 in the present exemplary embodiment comprises two stitching heads 26 and a respective closer assigned to the same but not detectable in FIG. 1. The closer bends over staples 27 stuck into the brochures 30 to be stitched by way of the stitching heads 26, specifically the legs of the wire staples 27 which have penetrated the brochures 30.

Figures 2A, 2B:
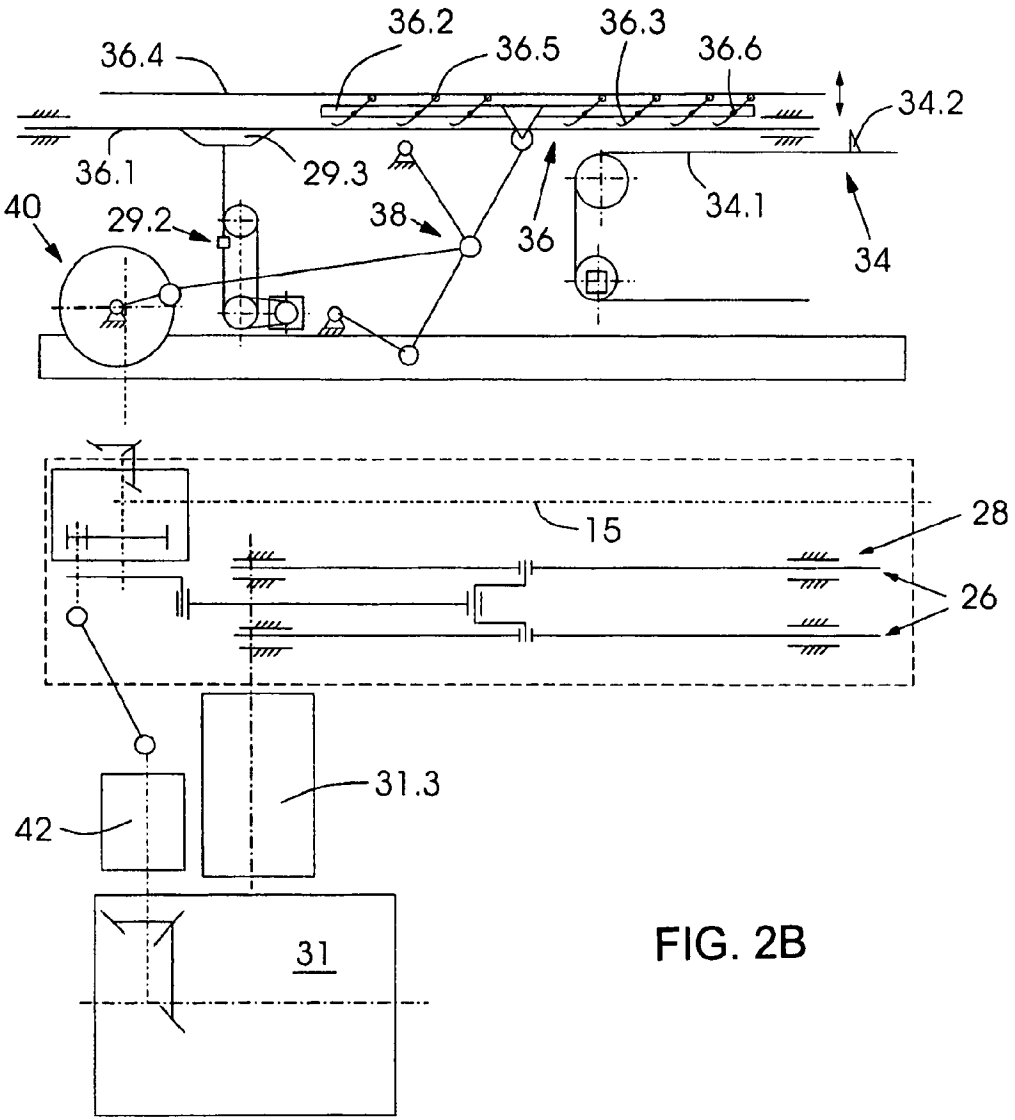
FIG. 2A is a schematic diagram of a side view of a gatherer stitcher, in which a continuous conveyor that can be charged with signatures by non-illustrated feeders, a transport system and a brochure ejector are indicated which, operated by means of an ejector drive, carries out a periodic ejection movement.
FIG. 2B is a schematic diagram of a plan view of the gatherer stitcher according to FIG. 2A, indicating a stitching machine, a trimming apparatus and its drive and also a trimmer feed.

The closers together with the stitching heads 26 and further non-illustrated apparatuses for producing the wire staples 27, form a machine component in the form of a stitching machine 28 (see FIG. 2B).

Figure 3A:
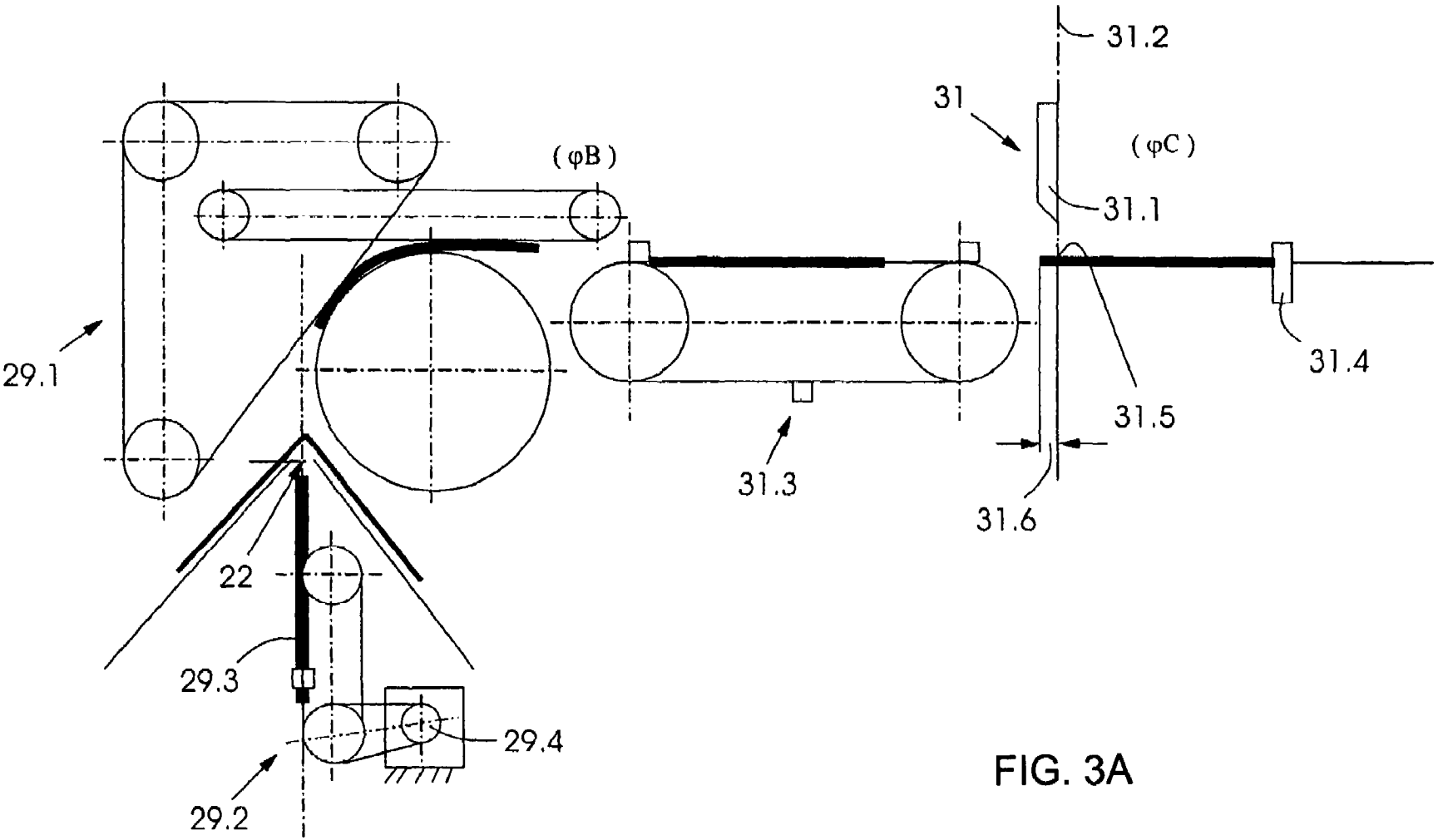
FIG. 3A is a schematic view of the transport of a wide brochure from a delivery station to a front cut knife assembly.
Figure 3B:
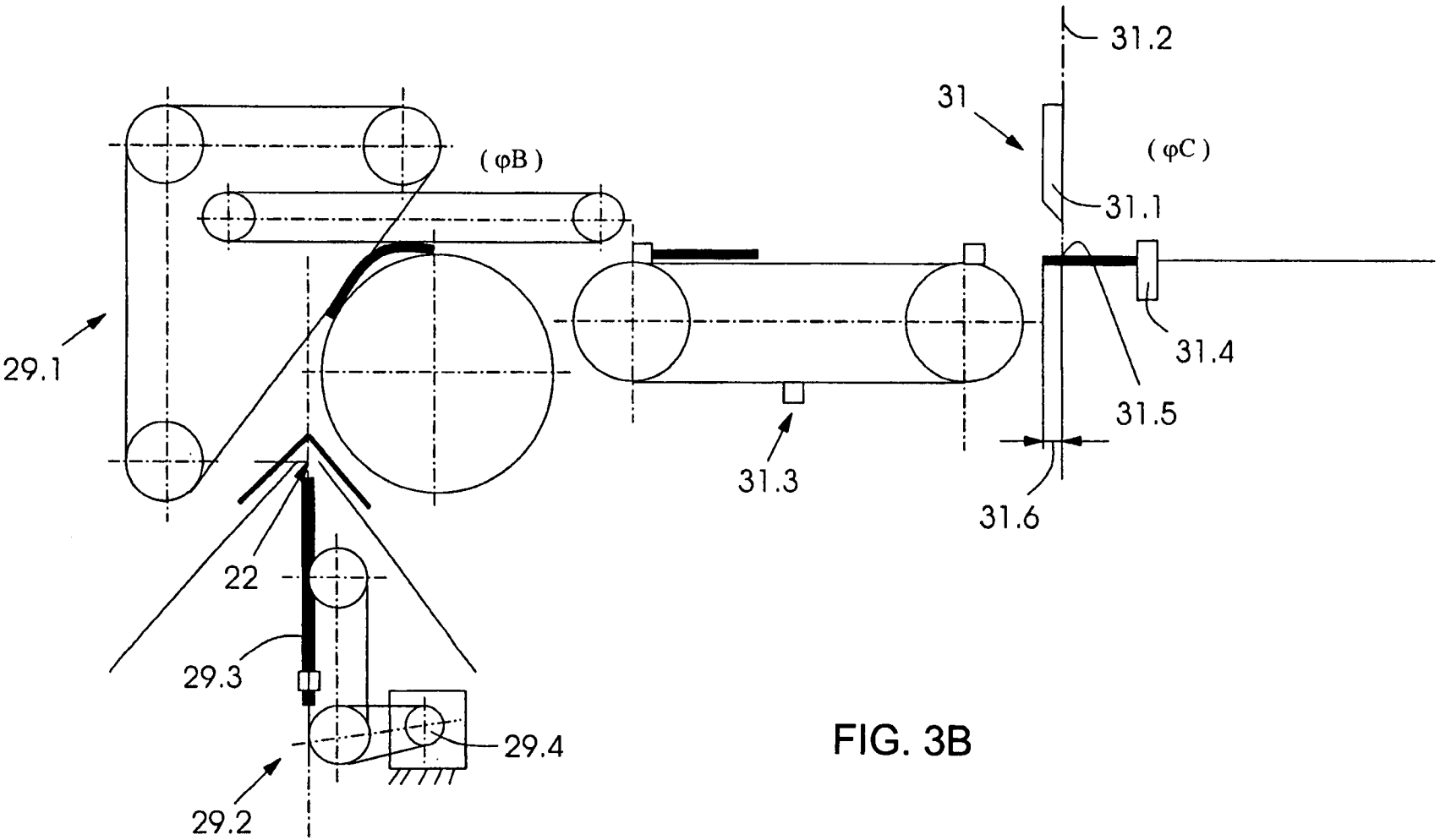
FIG. 3B is a schematic view of the transport of a narrow brochure from a delivery station to a front cut knife assembly.

The delivery station 29 comprises a brochure ejector 29.2 indicated in FIG. 2A having an ejector blade 29.3 and delivery tapes 29.1. The ejector blade 29.3 engages periodically in the respective fold of the stitched copies 32, lifts the latter out of the transport and stitching line 22 and transfers them to the delivery tapes 29.1, by means of which the stitched copies 32 are transported onward in the direction of the arrow T, specifically in the direction of a trimming apparatus 31, in which the stitched copies 32 are fed firstly to a front-edge knife arrangement 31.1, indicated in FIGS. 3*a* and 3*b*, which defines a cut plane 31.2 and is provided in order to trim the trailing edge of the brochures 30 along an intended cut line 31.5.

In order to operate the brochure ejector 29.2, a reversing ejector drive 29.4 is provided, which imparts a periodic ejection movement to the brochure ejector 29.2, more precisely the ejector blade 29.3.

A measuring station 33 is provided upstream of the stitching station 24, with respect to the transport direction P. In the measuring station 33 the thickness of the brochures 30 to be stitched is determined.

The continuous conveyor 34 in the present exemplary embodiment is constructed as an endless gathering chain which circulates during operation and on which drivers 34.2 are disposed, which push in front of them the signatures 16, 18, 20 transferred to the gathering chain astride, and ultimately the brochures 30 to be stitched.

FIG. 2A reproduces a schematic diagram of a section of the gatherer stitcher comprising the stitching station 24. In this section, a transport run 34.1 of the continuous conveyor 34 constructed as a gathering chain, and the further transport of the brochures 30 is carried out step by step by means of a finger-strip system 36 which oscillates during operation, although this is merely reproduced schematically in FIG. 2*a*. It comprises an anvil strip 36.1 for engaging under the brochures 30 to be stitched and a finger strip 36.2 that oscillates together with the anvil strip 36.1. Fingers 36.3 which can be actuated are arranged on the finger strip 36.2. The fingers 36.3 can be actuated in that they are attached to the finger strip 36.2 by means of an articulated connection 36.6 such that they can be pivoted in the direction of the anvil strip 36.1 and in the opposite direction, are prestressed in the pivoting direction of the anvil strip 36.1 and, under the action of the control strip 36.4 executing a reciprocating movement during operation, indicated by the double arrow in FIG. 2*a*, can in particular be pivoted away from the anvil strip 36.1. At their ends facing away from the control strip 36.4, the fingers 36.3 are preferably provided with freely rotatable rollers 36.5, which, during an adjustment of the control strip 36.4 in the direction of the finger strip 36.2 or in the opposite direction, roll on the control strip 36.4.

For the oscillatory movement of the finger-strip system 36, the latter is attached to a coupler of a coupler mechanism 38, which in turn is driven by means of a crank drive 40. The drive means provided for the actuation of the crank drive 40 and therefore for the oscillatory movement of the finger-strip system 36 is represented in the present exemplary embodiment by a stitching machine drive 42 also provided for the actuation of the stitching heads 26 (see FIG. 2B).

The stitching machine drive 42 is also used to drive the feeders 10, 12, 14 via a drive shaft 15 that is common to the latter, and also the trimming apparatus 31 (see FIG. 2B).

In any case in the extended position of the crank drive 40 and at least as far as a specific crank angle, of 16 degrees in the present exemplary embodiment, the anvil strip 36.1 and the finger strip 36.2, on the one hand, and the transport run 34.1 of the continuous conveyor 34 are overlapped, so that the anvil strip 36.1 can engage under a brochure 30 located in the correct position on the transport run 34.1, and the fingers 36.3 of the finger strip 36.2 can press the brochure 30 against the anvil strip 36.1, with the control strip 36.4 set off. This is carried out with equal speeds of the finger-strip system 36 and of the continuous conveyor 34, in the present exemplary embodiment at a crank angle of 16 degrees, which thus defines a point of engagement. The fingers 36.3 remain pressed against the accepted brochure 30 until the top position of the crank drive 40 is reached. During the zero passage of the speed of the finger strip 36, which takes place here, the brochure 30 is then deposited on the transport and stitching line 22 at a deposit point.

After the zero passage of the speed of the finger-strip system 36 has taken place in the top position of the crank 40, the finger-strip system 36 reverses its direction of movement and finally assumes an overlapped position again, corresponding to the crank angle of 0 degrees, with the transport run 34.1 of the continuous conveyor 34, that is to say the starting point for a further cycle of the type described above.

The finger-strip system 36 thus transports a brochure accepted from the continuous conveyor 34 step by step with a step length, which corresponds to a distance, which is covered, beginning at the point of engagement, until the deposit point is reached.

A brochure 30 accepted from the continuous conveyor 34 in a cycle of the finger-strip system 36 and, after a first step, deposited on the transport and stitching line 22, is again gripped by the finger-strip system 36 in the following cycle and transported onward a further time by the aforementioned step length. For a respective brochure 30, this procedure is repeated until it has reached the delivery station 29 after stitching has been carried out. Starting from this point, the brochures are supplied to the trimming apparatus 31 by transport means. The transport means in any case comprise the brochure ejector 29.2 having an ejector drive 29.4 and a trimmer feed 31.3.

After the brochures 30 have been lifted out of the transport and stitching line 22, the further transport of the brochures 30 is initially carried out by means of the delivery tapes 29.1, specifically transversely with respect to the transport direction defined up to this point by the continuous conveyor 34 and the finger-strip system 36. The delivery tapes 29.1 transfer a respective brochure to the trimmer feed 31.3 (see FIG. 2B), which transfers the brochures 30 with a uniform speed on transport and alignment tapes, not illustrated here, provided on the trimming apparatus 31, which circulate in a cyclic manner and at a speed which is greater than that of the brochures 30 in the trimmer feed 31.3 and which align the spines of a respective brochure 30 with a stop 31.4 in such a way that the intended cut line 31.5 lies in the cut plane 31.2 (see FIGS. 3A, 3B).

In the subject of the invention, this state is always reached at one and the same phase angle of the stitching machine 28, both when trimming wide brochures 30 and when trimming narrow brochures 30', that is to say irrespective of the brochure width.

In order to achieve this, in the refinement used as a basis here, it is ensured by means of a control system 48 (see FIG. 4) that the brochures 30, 30' are lifted out of the transport and stitching line 22 by the ejector blade 29.3 at different phase angles of the stitching machine 28, depending on their width. In this case, the phase angle of the stitching machine 28 at the time at which a brochure 30, 30' is lifted out of the transport and stitching line 22 is larger the smaller the width of the brochure 30, 30', and it is chosen such that, when a specific first phase angle $\phi B$ is reached after the brochure 30, 30' has been lifted out of the transport and stitching line 22, the trailing ends of the brochures 30, 30' are located substantially at one and the same location, only depending on the width of the strip 31.6 to be separated from the brochures 30, 30' and on the speed relationships of the trimmer feed 31.3 and the transport and alignment tapes provided on the trimming apparatus 31, and such that, after a second phase angle $\phi C$, larger than the first, has been reached, the intended cut line 31.5 lies in the cut plane 31.2, irrespective of the width of the brochure 30, 30' (see FIGS. 3A and 3B).

Figure 4:
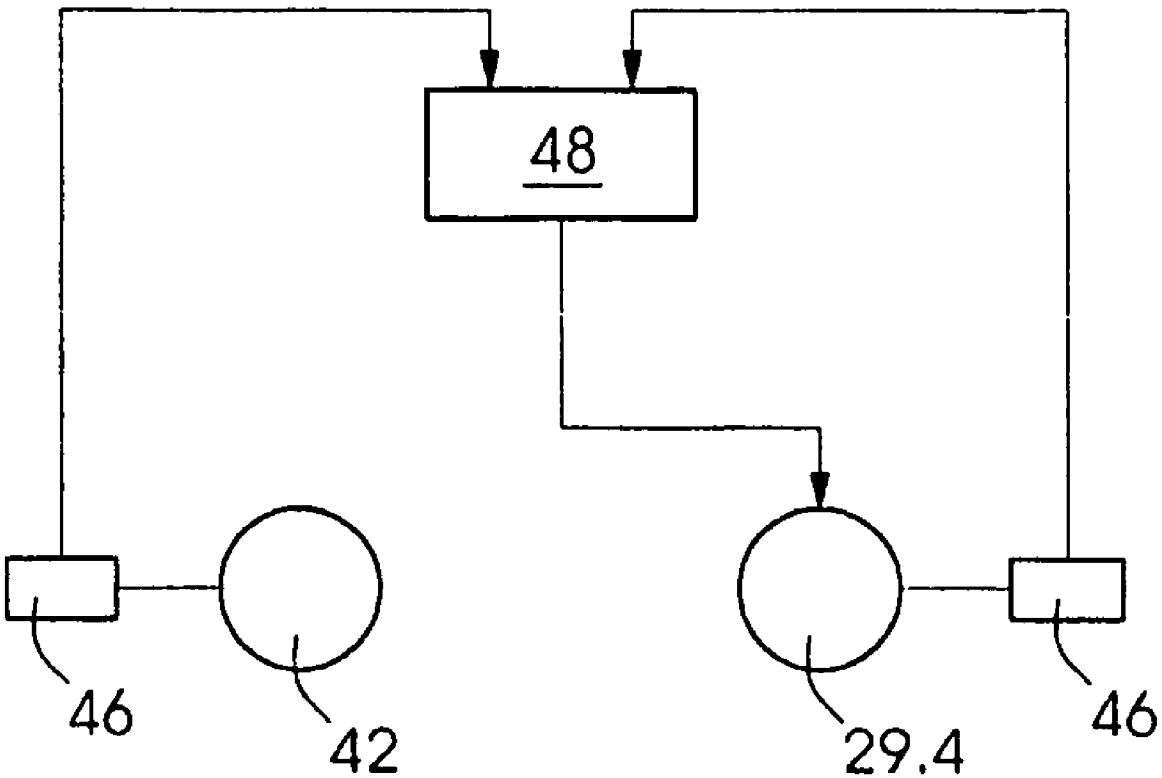
FIG. 4 is a block diagram for an adjustment of the starting point of the respective ejection movement.

In order to implement this, appropriate activation of the ejector drive 29.4 is carried out by the control system 48 which, in order to output an appropriate activation signal, processes the signals output by sensors 46, which define the phase angles of the stitching machine 28, more precisely the stitching machine drive 42, and of the ejector drive (see FIG. 4).

Although the explanations above are based on the brochure ejector 29.2 or its ejector drive 29.4 as the activated transport means component, the scope of the invention includes, for example, activating the trimmer feed 31.3 in such a way that, at a predetermined phase angle of the stitching machine 28, the intended cut line 31.5 of a respective brochure 30, 30' lies in the cut plane 31.2, irrespective of the width of the brochures 30, 30'.

This application claims the priority, under 35 U.S.C. § 119, of German patent application No. 102004021960.5, filed May 4, 2004; the entire disclosure of the prior application is herewith incorporated by reference.

We claim:

1. A gatherer stitcher for brochures, comprising:

a stitching machine;

a delivery station receiving brochures step-by-step during operation;

a front cut knife assembly defining a cutting plane for trimming the brochures along a respective intended cut line;

transport components for transporting the brochures from the delivery station to the front cut knife assembly during operation;

sensors configured to output signals defining phase positions of said stitching machine and of one of said transport components; and a control system connected to receive and process the signals from said sensors, and to activate said one transport component such that, given a predetermined phase position of said stitching machine, the respective intended cut line is located in the cut plane, independently of a width of the respective brochure.

2. The gatherer stitcher according to claim 1, wherein said transport components comprise a brochure ejector and an ejector drive for imparting a periodic ejection movement to said brochure ejector, one of said sensors is disposed to detect a phase angle of said ejector drive, and said control system is configured to activate said ejector drive accordingly.

3. The gatherer stitcher according to claim 1, wherein said transport components include a brochure ejector and a trimmer feed.

* * * * *